US005259068A

United States Patent [19]

Carroll

[11] Patent Number: 5,259,068

[45] Date of Patent: Nov. 9, 1993

[54] NURSING COVER

[76] Inventor: Teresa P. Carroll, 6309 Eastbrook Dr., Tuscaloosa, Ala. 35405

[21] Appl. No.: 853,290

[22] Filed: Mar. 18, 1992

[51] Int. Cl.[5] ..... A41D 1/20; A41D 1/22

[52] U.S. Cl. ..... 2/104; 2/88

[58] Field of Search ..... 2/46, 48, 49 R, 50, 2/51, 88, 104, 105, 106, 114; 450/36

[56] References Cited

U.S. PATENT DOCUMENTS

| | | | |
|---|---|---|---|
| 890,614 | 6/1908 | Gulver | 2/104 |
| 1,694,206 | 12/1928 | Clements | 2/106 X |
| 1,963,130 | 6/1934 | Hall | 2/49 R |
| 2,620,475 | 12/1952 | Legg et al. | 2/105 X |
| 2,674,738 | 4/1954 | Mehlos | 2/48 |
| 3,423,761 | 1/1969 | Nickerson | 2/104 X |
| 3,449,763 | 6/1969 | Grate | 2/104 |
| 4,031,566 | 6/1977 | Johnson | 2/104 |
| 4,144,593 | 3/1979 | Timmons | 2/104 |
| 4,458,365 | 7/1984 | Wood | 2/104 |
| 4,528,699 | 7/1985 | Hughes | 2/104 |
| 4,651,349 | 3/1987 | Heiler | 2/104 |
| 4,663,782 | 5/1987 | Knox | 2/104 |
| 4,712,251 | 12/1987 | Cobble | 2/104 |
| 4,713,842 | 12/1987 | Patterson | 2/104 |
| 4,924,528 | 5/1990 | Trombelti-Dickens | 2/46 |
| 4,964,172 | 10/1990 | Bollard | 2/104 |
| 4,987,612 | 1/1991 | Middleton | 2/104 |
| 4,995,116 | 2/1991 | Beauchamp et al. | 2/88 X |
| 5,034,999 | 7/1991 | Lubbers | 2/104 |
| 5,090,059 | 2/1992 | Kahl | 2/104 |

FOREIGN PATENT DOCUMENTS

| | | | |
|---|---|---|---|
| 213045 | 10/1955 | Australia | 2/88 |
| 2042756 | 3/1972 | Fed. Rep. of Germany | 2/88 |
| 302092 | 12/1928 | United Kingdom | 2/88 |
| 456037 | 11/1936 | United Kingdom | 2/49 |
| 1095397 | 12/1967 | United Kingdom | 2/49 R |

*Primary Examiner*—Clifford D. Crowder
*Assistant Examiner*—Jeanette E. Chapman
*Attorney, Agent, or Firm*—Nies, Kurz, Bergert & Tamburro

[57] ABSTRACT

A nursing cover for use by a mother in nursing an infant is disclosed. The cover is formed of a fabric material provided with a pair of horizontal pockets or slits which allow easy access to the infant for feeding along with improved viewing of the infant by the mother. Improved ventilation for the infant is also provided even while covered. Additional features include an elastic neckline and improved closure for the ends of the cover.

3 Claims, 2 Drawing Sheets

NURSING COVER

BACKGROUND AND SUMMARY OF THE INVENTION

The present invention relates to a nursing cover for use by a mother in nursing an infant. More particularly, the present invention relates to a cover or bib having specific features which allow easy nursing of an infant while also providing an improved cover for a nursing mother and her infant.

Previous bibs and nursing covers are described, for example, in the following U.S. Pat Nos. 3,423,761 to Nickerson; 4,144,593 to Timmons; 4,458,365 to Wood; 4,528,699 to Hughes; 4,663,782 to Knox et al.; and 4,924,528 to Trombetti-Dickens.

By the present invention there is provided an improved cover for nursing mothers which allows easy access to the infant for feeding along with improved viewing features which allow the mother to view the infant and also providing improved ventilation for the infant even while covered.

DESCRIPTION OF THE PREFERRED EMBODIMENTS

Figure 1:
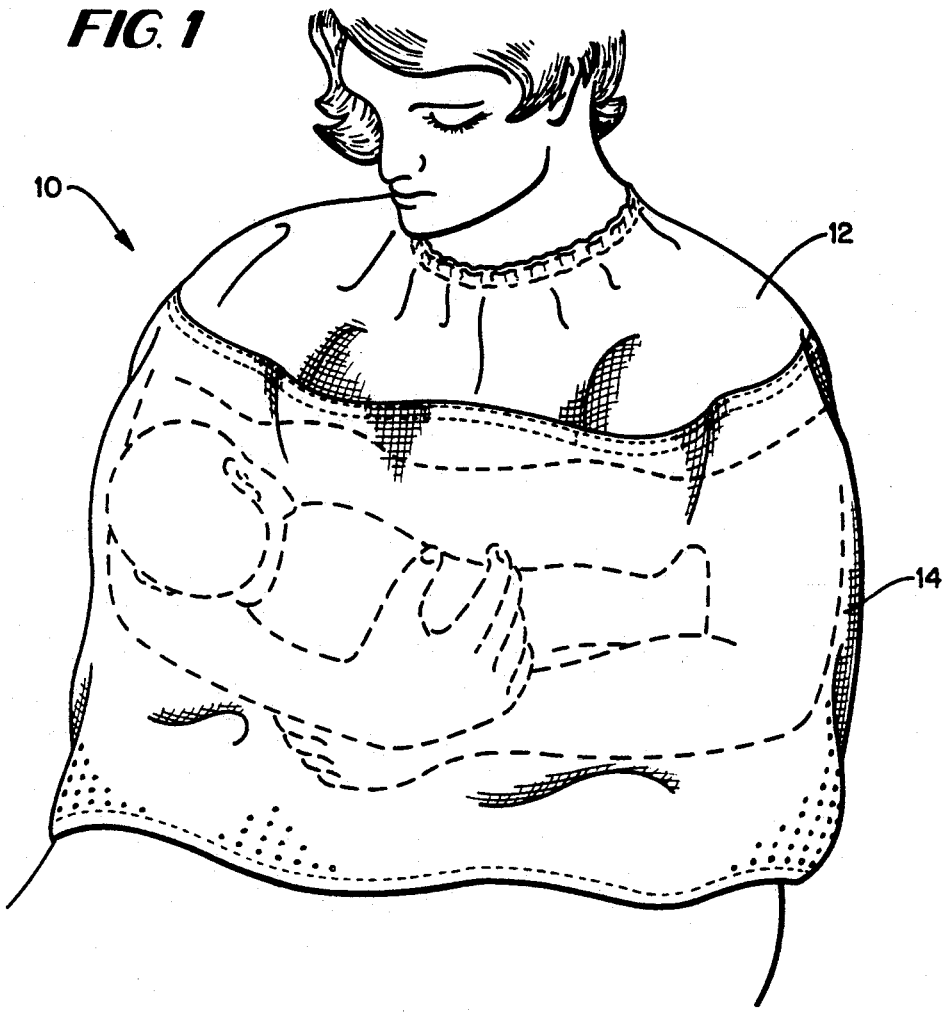
FIG. 1 is a perspective view showing a nursing mother and infant covered by the nursing cover of the present invention.
Figure 2:
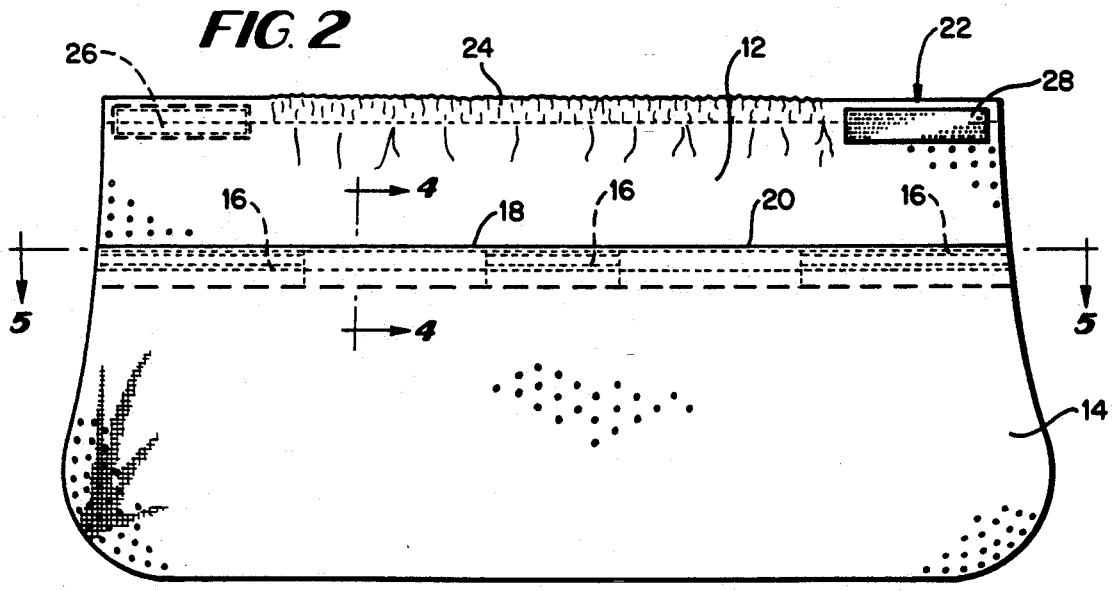
FIG. 2 is a front view of the nursing cover of the invention.
Figure 5:
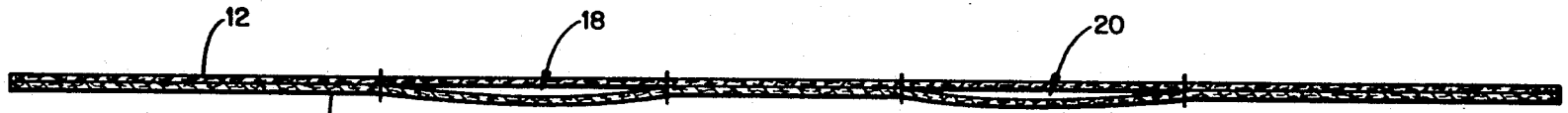
FIG. 5 is a cross-sectional view taken along line 5—5 of FIG. 2.
Figure 4:
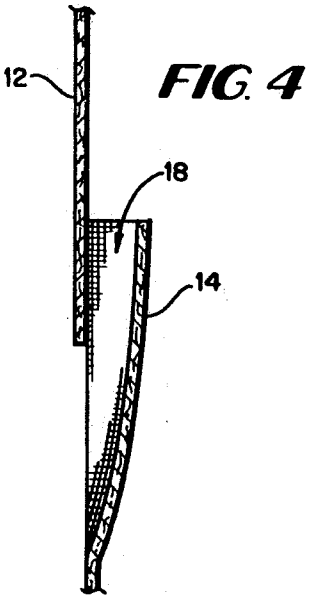
FIG. 4 is a cross-sectional view taken along line 4—4 of FIG. 2.
Figure 3:
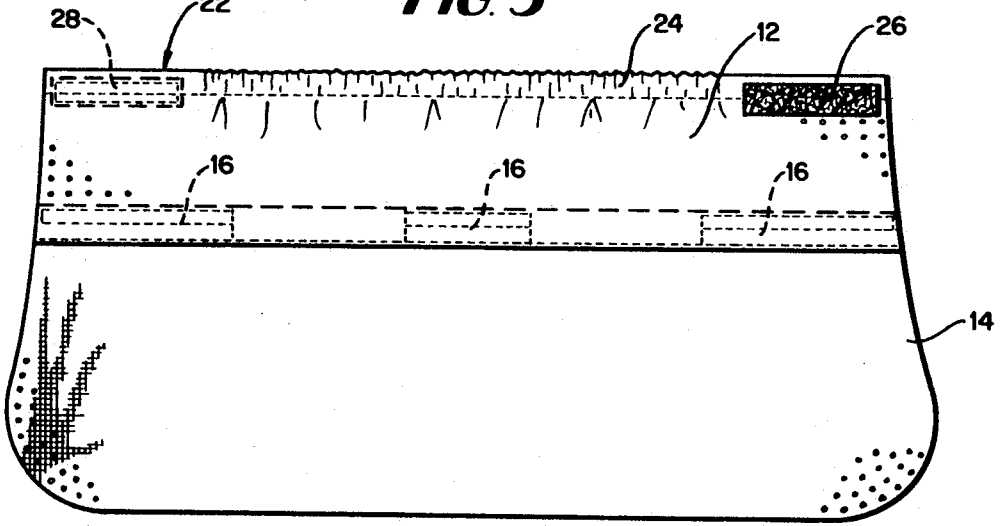
FIG. 3 is a rear view of the nursing cover of FIG. 2, showing the inside of the garment.

In the embodiment of the present invention as shown in FIGS. 1-5, there is provided a nursing cover or bib 10 which includes an upper panel 12 and a lower panel 14. The panels 12 and 14, which may be of a soft cotton or other natural or blended natural fabric, are interconnected by stitching 16 or other suitable means, as shown in FIGS. 2 and 3. Such stitching 16 is interrupted at 18 and 20 to provide a pair of horizontal viewing slits which allow the mother to view her infant while nursing. The construction of one of the slits 18 is shown in detail in FIG. 4 and it is seen that the panels 12, 14 overlap in forming the slit 18.

Along the top edge 22 of the upper panel 12 there is provided elastic reinforcement 24 which is sewn into a casing in the fabric so as to provide an expandable feature adjacent the neck of the nursing mother.

At opposite ends of the top edge 22 there are located a pair of releasable adhesive closure strips 26 and 28 of Velcro or other suitable material to allow the ends of the cover 10 to be secured together adjacent the top of the garment 10. These strips 26, 28 extend horizontally, thus allowing the size of the garment 10 to be adjusted over a wide range.

The nursing cover 10 of the present invention features two horizontal slits 18, 20 that are positioned high enough to avoid breast exposure while in use. The slits 18, 20 should be of a length which is sufficiently long so as to provide a clear view of the nursing infant by the mother while being short enough so as not to cause too much gapping. In one embodiment, each slit 18, 20 had a length of approximately 9 inches. The slits 18, 20 serve the following purposes:

1. The slits 18, 20 allow the mother to have her infant in view while nursing. This is important for the reasons below:

a. The slits allow the mother to view her infant while assisting the infant in correctly latching onto the breast. Many infants, particularly newborns, will require latching on several times before being properly positioned. Also while feeding, an infant may pull off the breast and require repositioning.

b. The slits allow the mother to view her infant while alternating breasts during feeding.

c. The slits allow the mother to view the position of her infant so as to facilitate repositioning the infant as needed while nursing.

d. The slits allow the mother to determine that her infant is breathing. Without being able to see her infant, mothers would be apprehensive in placing a cover over the infant.

2. The slits 18, 20 provide privacy and allow the mother to view the adjustment of her own clothing before, during, and after nursing.

3. The viewing slits 18, 20 allow the mother to fasten the nursing cover 10 prior to positioning the infant, thus helping to maximize nursing privacy. With other covers that do not allow easy viewing of the infant, fastening the cover would be more difficult after having positioned the infant.

4. The opened slits 18, 20 allow for direct air circulation to the infant.

The nursing cover 10 of the present invention also features an elastic neckline 24 which is useful for the following purposes:

1. The neckline 24 provides fullness in the cover 10 to help cover the mother and infant while nursing.

2. The elastic neckline 24 assists in allowing the cover 10 to yield or give without unfastening if pulled on by the infant.

The adhesive horizontal closure 26, 28 serves the following purposes:

1. The adhesive closure 26, 28 allows for ease in placing the cover 10 on and off the infant.

2. The adhesive closure 26, 28 does not require that the cover 10 be placed over the mother's head. Thus, a mother would not have to be concerned about her hair style.

3. The horizontal adhesive closure 26, 28 allows for size adjustment by the wearer.

4. The relatively large size of the closure members 26, 28 allows for more strength of the adhesive material.

For commercial use, the cover 10 is advantageously made of a material known as eyelet material to provide a fabric which is eye appealing and light weight while also being machine washable. In addition, such fabric allows for additional air circulation through the embroidered eyelet holes.

For hospital use, a tie closure could be used as well as a fabric approved by the various facilities if needed.

The nursing cover 10 of the present invention is light weight and folds compactly for ease in storage and transporting. The cover 10 also allows the mother's shoulders and arms to be covered while nursing, thus allowing for increased coverage compared with previous devices. In addition, the cover 10 would allow the mother to discretely use a breast pump while in the presence of others. This would be particularly helpful since complete privacy is not always provided in the hospital, work, or home setting.

The length of the cover 10 of the present invention allows for the infant to be completely covered. This is particularly useful for privacy when removing the infant's head away from the breast.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A nursing cover formed of a fabric material, said cover being of a size sufficient to extend over the upper body of a mother and also over an infant being nursed by the mother, comprising:

a planar member formed by upper and lower panels with the lower panel partially superimposed over the upper panel and having a pair of horizontally extending viewing slits formed so that a portion of the material surrounding the slits provides a vertical overlap of said upper and lower panels of the material, wherein said upper and lower panels are secured together on opposite sides of each of the slits; said upper panel having an elasticized upper edge; and closure means positioned on opposite ends of said planar member for securing the cover around the mother, said closure means being adjustable to provide for varying the size of the cover.

2. The nursing cover of claim 1 wherein each slit has a length of approximately 9 inches.

3. The nursing cover of claim 1 wherein the adjustable closure means includes a pair of releasable adhesive closure strips which extend in a horizontal direction, thus allowing the size of the nursing cover to be adjusted over a wide range.

* * * * *